United States Patent [19]

Elko et al.

[11] Patent Number: 4,802,227

[45] Date of Patent: Jan. 31, 1989

[54] NOISE REDUCTION PROCESSING ARRANGEMENT FOR MICROPHONE ARRAYS

[75] Inventors: Gary W. Elko, Summit; Man M. Sondhi, Berkeley Heights; James E. West, Plainfield, all of N.J.

[73] Assignees: American Telephone and Telegraph Company; AT&T Bell Laboratories, Murray Hill, N.J.

[21] Appl. No.: 34,816

[22] Filed: Apr. 3, 1987

[51] Int. Cl.[4] ..... H04R 3/00

[52] U.S. Cl. ..... 381/92; 381/94; 367/123

[58] Field of Search ..... 367/121, 119, 123, 124; 381/92, 94, 56

[56] References Cited

U.S. PATENT DOCUMENTS

| | | | |
|---|---|---|---|
| 4,228,531 | 10/1980 | Bogert et al. | 367/121 |
| 4,485,484 | 11/1984 | Flanagan | 381/92 |
| 4,536,887 | 8/1985 | Kaneda et al. | 381/92 |
| 4,559,642 | 12/1985 | Naotaka et al. | 381/92 |
| 4,581,758 | 4/1986 | Coker et al. | 381/92 |

OTHER PUBLICATIONS

*Proceedings of the IEEE*, vol. 60, No. 8, 8/72, "An Algorithm for Linearly Constrained Adaptive Array Processing", by O. L. Frost, III, pp. 926–935.

*Primary Examiner*—Forester W. Isen

*Attorney, Agent, or Firm*—Wilford L. Wisner; Jack S. Cubert

[57] ABSTRACT

A sound processing arrangement couples sound from a prescribed environment through a fixed microphone array to a signal processing arrangement having a specifiable preferred sound source location. The microphone pickup signals are combined with a set of weighting signals to adjust the directional response pattern in successive analysis time intervals. The weighting signals are modified in each analysis time interval so that the total acoustic signal power of the signal processing arrangement output signal is decreased toward a minimum while substantially unity power transfer of sound signals from said preferred location is maintained at all frequencies over a prescribed frequency range. In this way, the preferred source location is in the main beam while unwanted sound source locations are at the null points of the adjusted directional response pattern.

13 Claims, 8 Drawing Sheets

NOISE REDUCTION PROCESSING ARRANGEMENT FOR MICROPHONE ARRAYS

FIELD OF THE INVENTION

The invention relates to sound pickup and more particularly to array type sound pickup apparatus for modifying directional response patterns to improve noise discrimination.

BACKGROUND OF THE INVENTION

Speech processing systems such as automatic speech recognizers do not operate well in noisy environments. Consequently, microphone pickups for such systems must discriminate against noise and reverberation to maintain proper speech processing operation. Commonly used fixed microphone arrays with fixed directional response patterns may be preset to provide maximum response in one or more directions but such fixed arrays are highly susceptible to environmental interference due to sidelobe response and noise sources that change location. Some prior art speech recognition arrangements have avoided pickup of unwanted sounds through use of a special noise canceling microphone device close to the talker whose speech is to be recognized. While microphone placement very close to the speech source reduces the effect of background noise, the talker is required to hold the pickup device or wear a device containing the pickup device to maintain the close spacing. The talker's movements, however, may be restricted by the pickup device and he may be subjected to some discomfort. It is therefore desirable to provide a microphone arrangement that automatically adapts its directional response pattern to minimize unwanted sound pickup without being attached to or in close proximity to the talker.

U.S. Pat. No. 4,559,642 discloses phased array sound pickup apparatus that includes an array of directional microphones having individual directivity patterns equally oriented in a given direction. The directivity patterns of the microphones combine into the main lobe of the array. A plurality of variable delay circuits is connected to the microphones to provide incremental delays to the individual microphone signals and the delayed microphone signals are combined for delivery as an output of the apparatus. A delay control circuit is coupled to variable delay circuits to control the amount of the individual signal delays, and the delay control signals cause the main lobe to be steered to the given direction. In this manner, the need for close proximity between a talker and a sound pickup device is obviated. Adjustment of the delay signals, however, is performed manually and requires the services of a skilled operator. While the arrangement may be practical for large gatherings, it is uneconomical in speech processing applications such as those associated with computer terminals or personal computers where relatively few individuals are involved.

U.S. Pat. No. 4,536,887 describes microphone array apparatus and a method for extracting desired signals therefrom in which an acoustic signal is received by a plurality of microphone elements. The element outputs are delayed by delay means and weighted and summed up by weighted summation means to obtain a noise-reduced output. A "fictitious" desired signal is electrically generated and the weighting values of the weighted summation means are determined based on the fictitious desired signal and the outputs of the microphone elements when receiving only noise but no input signal. In this way, the adjustments are made without operator intervention. The requirement of an environment having substantially only noise sources, however, does not realistically reflect actual sound pickup situations where noise, reverberation and sound conditions change over relatively short time periods and the occurrence of desired sounds is unpredictable. It is an object of the invention to provide improved directional sound pickup that is adaptable to varying environmental conditions without operator intervention or a requirement of signal-free conditions for adaptation.

As disclosed in the article, "An Algorithm for Linearly Constrained Adaptive Array Processing", by O. L. Frost, III, *Proceedings of the IEEE,* Vol. 60, No. 8, August, 1972, pp. 926–935, further discussed below, in connection with FIG. 1, it is also known, in the field of fully automatic microphone array processing, how to reduce the effect of noise sources, while maintaining a chosen frequency characteristic for the array in the direction from which the signal is to be received, without the need for a signal in the microphone array circuitry to represent fictitiously the expected signal when none is present. Nevertheless, the constraints on the weighting of the signals from the various microphones of the array are so rigid, that frequently the Frost system will achieve very little reduction in noise. Therefore, it is an object of the invention to select such constraints to yield a better compromise of faithful reproduction of the signal and reduced noise power, while still not requiring the signal-free conditions and "fictitious desired signal" in the microphone array circuitry, as disclosed in U.S. Pat. No. 4,536,887.

SUMMARY OF THE INVENTION

The foregoing objects are achieved by coupling a fixed microphone array through a signal processing arrangement having a specifiable preferred sound source location in which microphone pickup signals are combined with a set of weighting signals to adjust the directional reaponse pattern in successive analysis time intervals. The weighting signals are modified in each analysis time interval so that the total acoustic signal power of the signal processing arrangement output signal is minimized while substantially unity power transfer of sound signals from said preferred location is maintained. In this way, the preferred signal location is always in the main beam of the microphone array while noise source locations are kept at the null points of the directional response pattern.

The invention is directed to an arrangement for processing sound in which a signal defining a preferred sound source location is generated and an array of electroacoustic transducers having a prescribed directional response pattern receives sounds from the preferred location as well as a plurality of unwanted sounds from other locations and produces signals responsive thereto. Successive time intervals for analyzing the preferred source location sound signals and the plurality of other location unwanted sound signals are defined. During each analysis time interval, a set of weighting signals are formed to adjust the directional response pattern of the array and the received sound signals are combined with the weighting signals to produce an output signal substantially representative of the sound signal from the preferred location sound source in each analysis time interval. In each analysis time interval, a signal representative of the input power of the received sound signals and a signal representative of the power of the output signal of the current time interval are generated responsive to the sound signals received in the current analysis time interval. A set of weighting signals for the current analysis time interval is formed responsive to the weighting signals of the preceding analysis time interval, the current analysis time interval input power and output power signals and said preferred location defining signal to direct the mainlobe of the prescribed directional response pattern toward the preferred location while directing null points of the prescribed directional response pattern toward the other changeable locations.

In another sense, the objects of the invention are achieved by eliminating concern with the phases of the desired signal in calculating weighting coefficients, as required in the Frost reference, and eliminating the need for delineating signal-free intervals and generating fictitious desired signals as required in U.S. Pat. No. 4,536,887, and concerning ourselves with power and distortion considerations.

DETAILED DESCRIPTION

Figure 1:
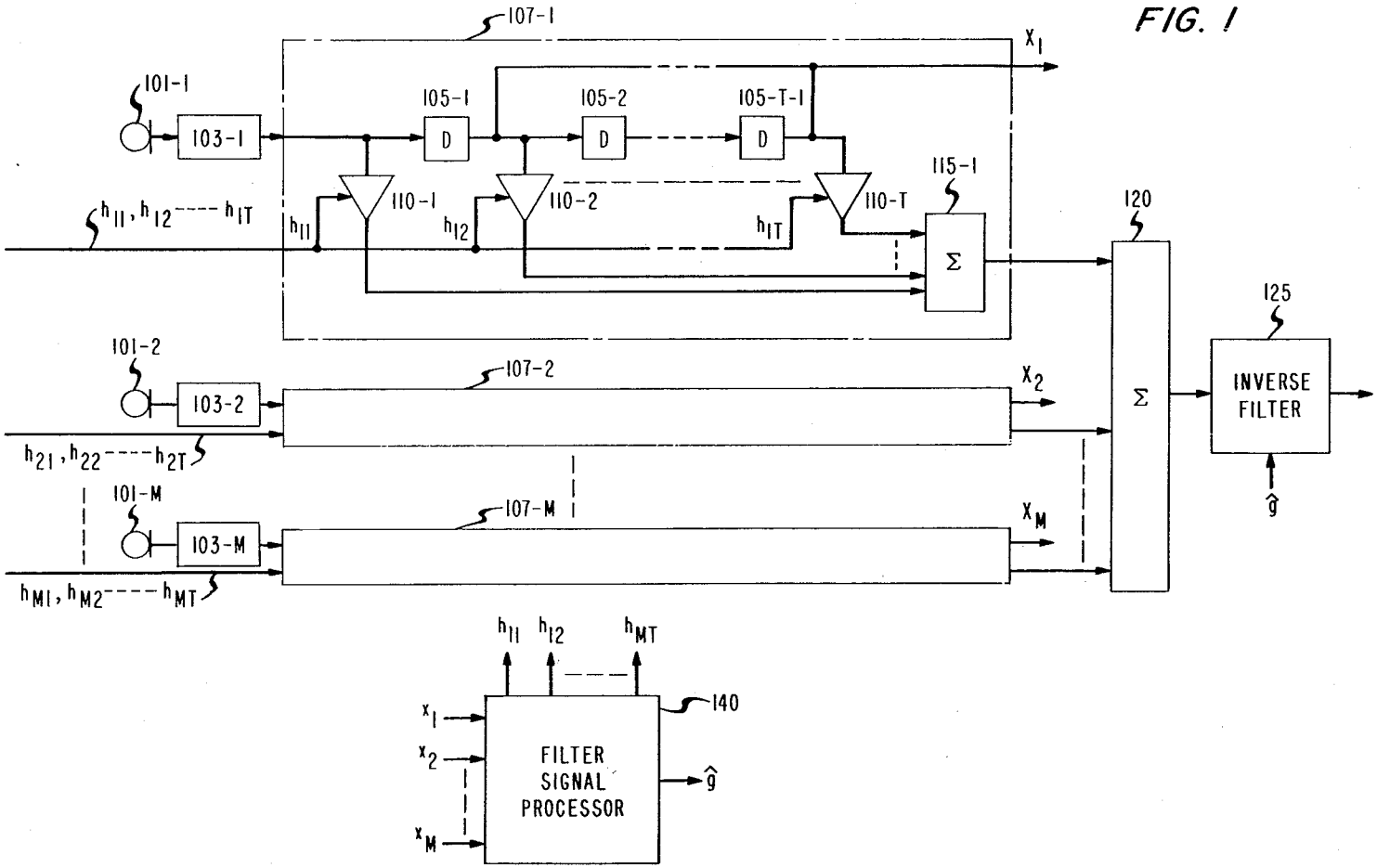
FIG. 1 depicts a general block diagram of a sound pickup system illustrative of the invention.
Figure 6:
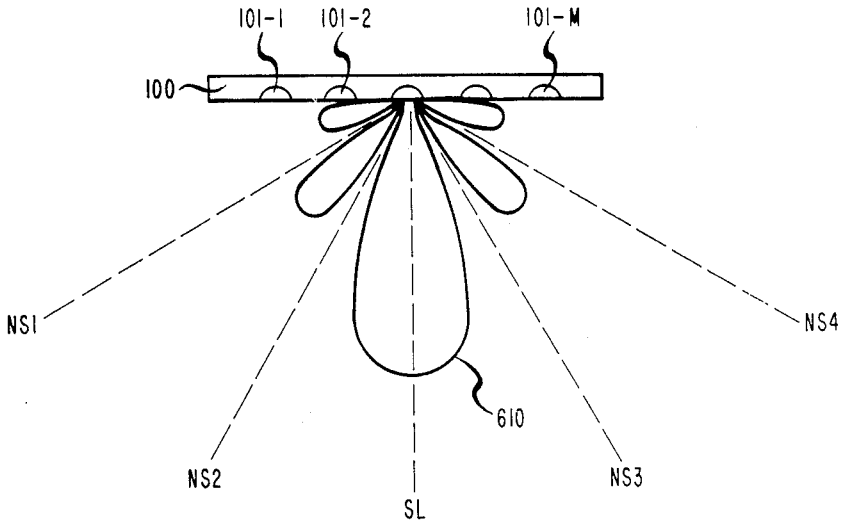
FIG. 6 illustrates microphone arrangements that may be used with the system of FIG. 1 and a typical directional sound pickup pattern obtained using the system of FIG. 1.

FIG. 6 shows physical arrangements of a computer terminal 100 in which automatic speech recognition is incorporated for a terminal operator and also illustrates a directional response pattern 610 obtained using the invention. The operator in FIG. 6 is positioned at a predefined location SL with respect to terminal 100 while unwanted signal or noise sources of various sorts are located at positions NS1, NS2, NS3 and NS4. While four noise source locations are shown in FIG. 6, it is to be understood that fewer or more noise sources may be accommodated limited only by the number of sound transducers in the system. The predefined location may be specified by the operator through use of techniques well known in the art such as detecting the position of a cursor on display screen arranged to display locations in the environment. Electroacoustic transducers 101-1 through 101-M are spatially arranged on display 100 of the terminal. Initially, the operator at position SL provides a location signal L via the terminal keyboard or other input device which signal L corresponds to his position with respect to microphones 101-1 to 101-M. Upon receiving location signal L, the circuit of FIG. 1 is operative to provide a directional response pattern 610 arranged so that location L is in its main beam and other sound locations are at null points of the pattern. Directional response pattern 610 is adaptively adjusted during successive time intervals to maintain the operator location SL in the main beam of the pattern while developing null points in the directional response pattern at each noise source NS1 through NS4 although the noise sources may move. In accordance with the invention, the directional response pattern shown in FIG. 6 is generated in repetitive analysis time intervals by the circuit of FIG. 1 so that the total acoustic signal power of the output signal obtained therefrom is minimized while unity power transfer of acoustic signals from said preferred location SL is substantially maintained at all frequencies of the frequency range of interest. A prescribed frequency range corresponding to speech sounds or a wider audio range may be chosen as the frequency range of interest. Sound pickup from the direction of the noise source locations is thereby minimized relative to sound pickup from the designated operator location even when the noise source locations change.

FIG. 1 depicts a general block diagram illustrating the principles of the invention. In FIG. 1, an array of microphones 101-1 through 101-M receive sound waves from a prescribed environment such as a room used as an office. The microphones may be mounted on a computer terminal display as illustrated in FIG. 6. Microphone 101-1 is connected to a transversal filter 107-1 comprising a set of serially connected delays 105-1 through 105-T via a location delay 103-1. The location delays are operative to control microphone array phasing so that sound from the preferred source arrives synchronously (simultaneously) at all transverse filters. The input of the first delay 105-1 and the outputs of all delays 105-2 through 105-T are coupled to summing device 115-1 via amplifiers 110-1 through 110-T, respectively. The gain of each transversal filter amplifier is modulated by a weighting signal adaptively formed in filter signal processor 140. For example, the gain of amplifier 110-1 is adjusted by weighting signal $h_{11}$. Transversal filters 107-2 through 107-M are similarly constructed and the outputs of summing devices 115-1 through 115-M are combined in summing device 120. The signal from summing device 120 is applied to inverse filter 125 from which an output signal is obtained that is substantially representative of sounds from location SL while substantially attenuating sounds from the noise sources. In effect, the directional response pattern of the microphone array is adjusted so that the preferred location is centered in the main beam of the directional response pattern of the microphone array and the unwanted signal source locations are at the null points of the directional response pattern.

The circuit of FIG. 1 utilizes an adaptive array of the general type described in the article "An Algorithm for Linear Constrained Adaptive Array Processing" by O. L. Frost III appearing in the Proceedings of the IEEE, Vol. 60 1972, pp. 926–935 and in the aforementioned U.S. Pat. No. 4,536,887. The transversal filter arrangement described therein adapts to minimize output power while maintaining a specific pure delay transfer function $G(j\omega)=e^{-j\omega\Delta}$ in the direction of the desired source. The disclosure of U.S. Pat. No. 4,536,887 replaces the aforementioned constraint on the transfer function of Frost by a constraint $$d=\int(G(j\omega)-1)^2 d\omega \leqq d_0 \quad (1)$$

ps where $G(j\omega)$ is the transfer function of the transversal filter at angular frequency $\omega$ of a sound signal from the preferred location source to the output and $d_0$ is a specified positive number. This arrangement is adaptive but requires the use of artificially generated test signals to simulate the desired signal during the optimization period of operation. If the noise source locations change during operation of the system, the test signal optimization must be repeated with only the noise sources present. In accordance with the invention, the optimization is done in successively recurring analysis time intervals without human intervention or specially produced test signals operating in a signal-free environment. Further, it is recognized that the quality of speech is insensitive to the phase of the transfer function so that, in accordance with the invention, only a constraint on the magnitude of the transfer function is necessary. Using a distortion measure $$D=\int(|G(j\omega)|^2 d\omega \tag{2}$$

reflecting such phase-insensitivity, a gradient search is performed to minimize the normalized output power with the constraint that $D \leqq D_0$ where $D_0$ is a specified limit value. This is accomplished by adjusting the tap weights of the transversal filter in the system in each analysis time interval responsive to the power in the signals received from the microphone array, the power in the output signal from the transversal filter arrangement and the signal defining the preferred location. As is known, the difficulties involved in using the constraint on D of equation 2 may be avoided by an unconstrained minimization of the cost function C as defined by $$C=P+\lambda D \tag{3}$$

where P is the normalized output power and $\lambda$ is a Lagrange multiplier. The value of $D_0$ obtained at the optimum settings of the transversal filters is implicity a function of $\lambda$ so that $\lambda$ may be varied to achieve the desired value of D.

For purposes of illustration, it is assumed that the microphone array of FIG. 1 is a line array and that the signals from the microphones are transformed into time-discrete samples. It is to be understood, however, that other array arrangements (planar or non-planar) may be used. The time interval between discrete samples, $T_s$, for the microphone signals is set to be equal to the unit delay of the delays 105-1 through 105-T-1 in each of the transversal filters 107-1 through 107-M. $x_{mt}(n)$ is the signal at the sampling instant n at the $t^{th}$ tap of the transversal filter for the $m^{th}$ microphone. $x_{mt}(n)$ is $x_m(n-t)$, where $x_m$ is the signal received by the $m^{th}$ microphone. The output of summing device 120 after transverse filtering of the microphone array signals at sampling instant n is $$o(n) = \sum_{m=1}^{M} \sum_{t=1}^{T} x_{mt}(n) h_{mt}(n). \tag{4}$$

If the MT dimensional column vectors $x_n$ and $h_n$ are the concatenated columns of the matrices $[x_{mt}(n)]$ and $[h_{mt}(n)]$ respectively, equation 4 may be written more compactly as $$o(n)=h_n' X_n, \tag{5}$$

where ' indicates vector transposition. The location delays 103-1 through 103-M cause the time origins for the delay lines of transversal filters 107-1 through 107-M to be such that the sound signals from the preferred location SL arrive synchronously at the input to each transversal filter. Thus, the location delays defined by the operator permit the sound signals from the preferred location to be distinguished from other location sound signals in the transverse filter arrangement. Except for a pure delay, therefore, the effective filter between the preferred location source and the output of the system is a transversal filter with tap weights $$g_t = \sum_{m=1}^{M} h_{mt},\ t = 1, 2, \ldots, T. \tag{6}$$

The discrete Fourier transform of the tap weight sequence $g_t$ is $$G_k = \sum_{t=1}^{T} g_t\, w^{(k-1)(t-1)},\ k = 1, \ldots, N_F \tag{7}$$

with $$w = e^{-j\frac{2\pi}{N_F}}.$$

The length of the Fourier transform, $N_F$, is some number $\geqq T$ depending upon the frequency resolution desired.

With the weighting signal vector h held constant so that it is independent of n, the normalized power P for a block of N consecutive samples is $$P = \frac{\sum_{n=1}^{N} o^2(n)}{\sum_{n=1}^{N} x_n' x_n} \tag{8}$$

which may be rewritten in matrix notation as $$P = \frac{\sum_{n=1}^{N} (h' x_n)^2}{\sum_{n=1}^{N} x_n' x_n} \tag{9}$$

and may be rearranged for simplification as $$P = h' \frac{\sum_{n=1}^{N} x_n x_n'}{\sum_{n=1}^{N} x_n' x_n} h. \tag{10}$$

The distortion, D, of equation 2 may be written in terms of the Fourier transform tap weights of equation 7 as $$D = \sum_{k=1}^{N_F} (1 - G_k G_k^*)^2, \tag{11}$$

where * indicates complex conjugation.

From equation 9, the gradient of P with respect to weighting vector h is readily seen to be $$\nabla P = 2 \frac{\sum_{n=1}^{N} x_n x_n'}{\sum_{n=1}^{N} x_n' x_n} h. \tag{12}$$

Let $(\nabla D)_{mt}$ be defined as the component of the gradient of D along the weight $h_{mt}$, i.e., the partial derivative of D with respect to $h_{mt}$. Then from equation 7 and 11, it follows that $$(\nabla D)_{mt} = -2\sum_{k=1}^{N_F}(1 - G_kG_k^*)(G_kw^{-(k-1)(t-1)} + G_k^*w^{+(k-1)(t-1)}). \quad (13)$$

As indicated in equation 13, $(\nabla D)_{mt}$ is independent of the microphone index, m. The adaptation arrangement of the invention may be described in terms of the aforementioned equations 12 and 13. For the first block of N samples, an initial weight vector $h^0$ is selected. Then for $k=1, 2, \ldots$ the vector is iteratively updated according to the equation $$h^{(k)}=h^{(k-1)}-\mu\nabla C \quad (14)$$

where C is the cost function of equation 3

$$=h^{(k-1)}-\mu[\nabla P+\lambda\nabla D], \quad (15)$$

where $\mu$ is a prescribed step size. In accordance with equation 15, the tap weights $h_{mt}$ may be adjusted to minimize the distortion D. One or more iterations for distortion minimization may be used. After a specified number of iterations k (e.g., one or two) the succeeding block of N samples is processed with the final weight vector of the previous block as initial vector.

A considerable reduction of noise is observed at the output of the transversal filter arrangement. But, at low frequencies such that the acoustic wavelength is large compared to sensor spacing, the filter has a diminished sensitivity compared to the sensitivity at higher frequencies of the prescribed frequency range. This gives the preferred location sounds, e.g., speech, a differentiated characteristic. While the sounds from the undesired noise sources are canceled at low frequencies as at other frequencies as aforementioned, the microphone array has low sensitivity for long wavelengths. This reduced low frequency sensitivity is primarily due to two mechanisms. First, as the wavelength becomes longer than the array dimensions, the microphone weighting must alternate in sign so that a null can be formed in the interference direction. The alternating sign weighting results in a pattern-differencing type array with concomitant reduction in array sensitivity. Secondly, at lower frequencies where the wavelength is much larger than the array, the finite-length adaptive filters associated with each transducer cannot adjust the magnitude and phase to the precision that is necessary to preserve the broadband null. The adaptive filters therefore begin to roll-off the signal in order to reduce the cost function. Consequently, there is low sensitivity in the low frequency range, and the output level of sound signals from the desired source is low. In accordance with the invention, the filter output signal o(n) is passed through an inverse filter 125 having a response characteristic that is substantially the inverse of the characteristic response of the circuit including filters 107-1 through 107-M. In this manner, the low frequency portion of the output of summer 120 is boosted and the overall gain for sounds received from the desired source at location SL is made substantially unity at all frequencies of the prescribed frequency range.

To obtain the inverse filter characteristics, a set of tap weight signals $z_i$ is formed from the impulse response of filters 107-1 through 107-M, $\hat{g}_i$ as follows to obtain greater resolution.

$$z_t=g_t \text{ for } t=1, 2, \ldots, T \quad (16)$$

$$z_t=0 \text{ for } T<t<N_F \quad (17)$$

where $N_F$ is set to an integer I which is a power of 2 and greater than T. $N_F$ is chosen in this fashion so that there is sufficient resolution in the weighting signals for the inverse filter. A set of signals $$Zn = \sum_{i=1}^{N_F} z_i e^{-2\pi j \frac{ni}{NF}} \text{ for } n = 1, 2, \ldots, N_F \quad (18)$$

correspond to the Fourier transform of signals $z_j$ at the resolution set by $N_F$. The tap weighting signals for the inverse filter, $\hat{g}_j$, are then produced by generating the inverse Fourier transform of $1/Z_n$ $$\hat{g}_k = \frac{1}{N_F}\sum_{n=1}^{N_F}\frac{1}{Z_n}e^{-\frac{2\pi j}{NF}nk} \text{ for } k = 1, 2, \ldots, N_F \quad (19)$$

These tap signals are applied to filter 125 whereby the output of the inverse filter has the minimum total acoustic signal power while substantially unity power transfer of acoustic signals from said preferred direction is maintained.

Figure 2:
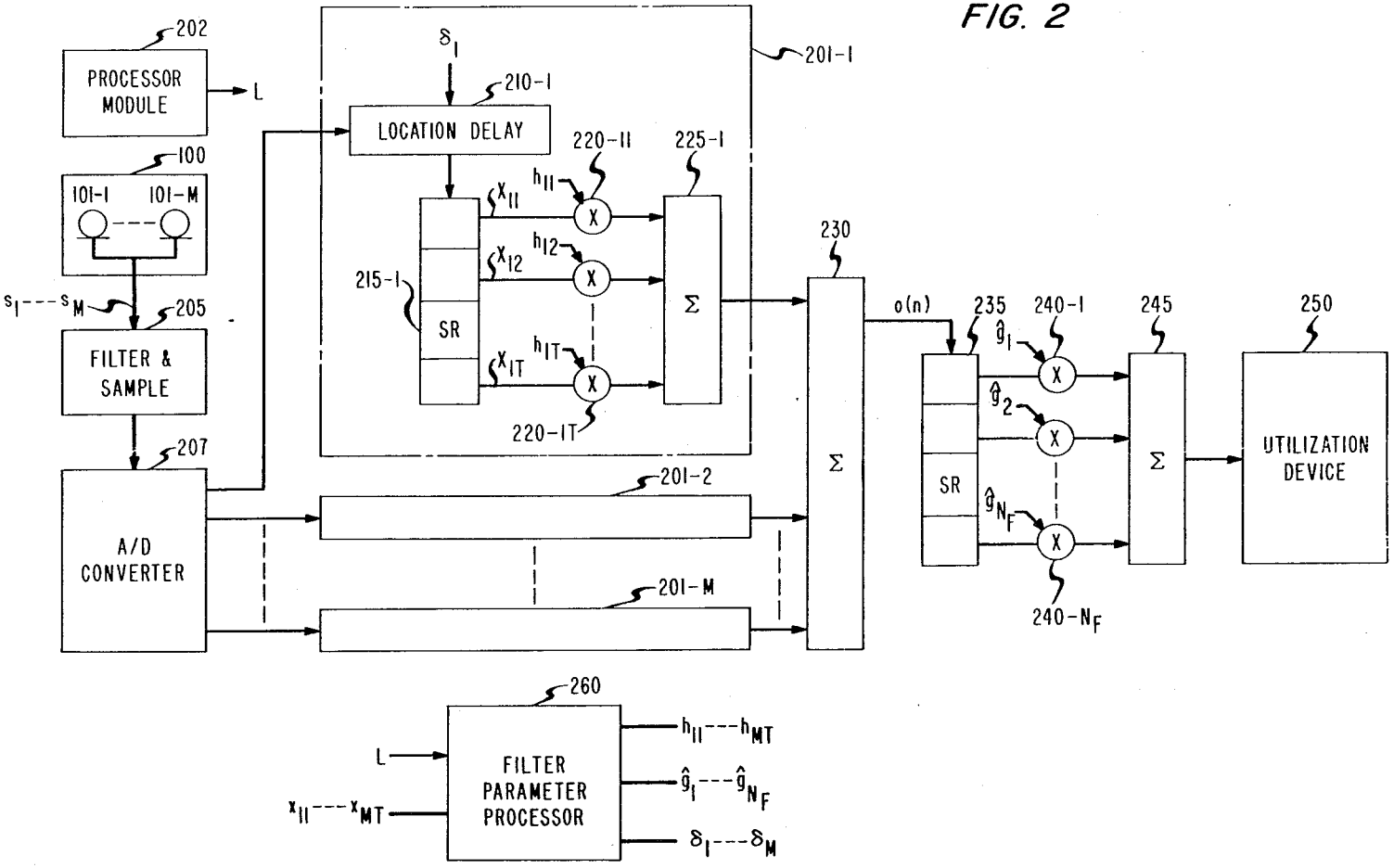
FIG. 2 depicts a more detailed block diagram of the sound pickup system of FIG. 1.
Figure 3:
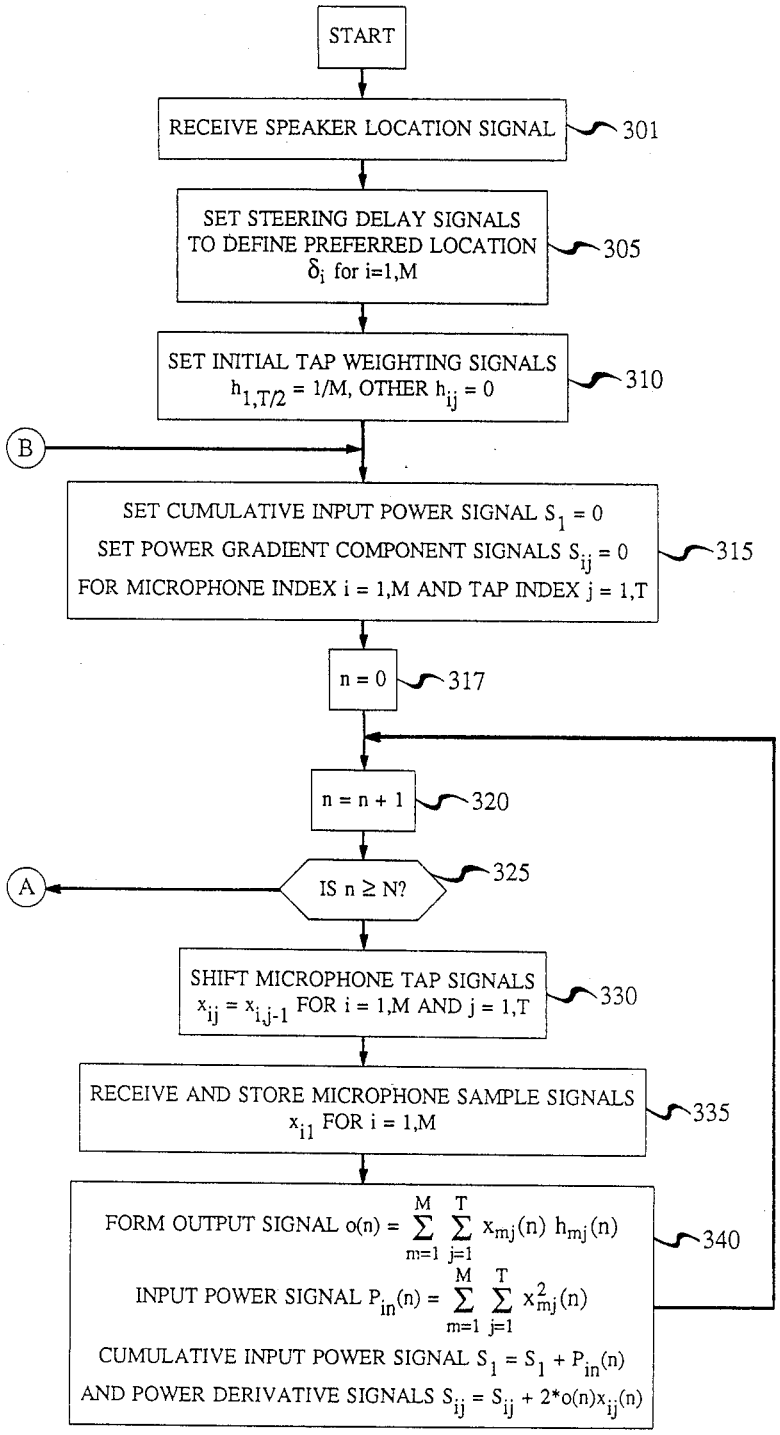
FIGS. 3, 4 and 10 depict flow charts illustrating the operation of the sound pickup system of FIG. 1.

FIG. 2 shows an embodiment of the invention in which electroacoustic transducers 101-1 to 101-M are spatially arranged on the display of a computer terminal device 100 to form a microphone array such as illustrated in FIG. 6. The display may be a cathode ray tube, liquid crystal or other such device well known in the art. The flow chart of FIG. 3 illustrates the operation of the circuit of FIG. 2. Referring to FIGS. 2 and 3, a talker location signal L is generated in processor module 202 responsive to keyboard entries of the operator as indicated in steps 301 and 305 of FIG. 3. If the operator location is fixed or centered with respect to the microphones 101-1 to 101-M, steps 301 and 305 may be eliminated. Location signal L is supplied to filter parameter processor 260 wherein a set of location delay control signals $\delta_1$ to $\delta_M$ are formed (step 305). The location delay control signals are operative to modify the phasing of digitally coded signals derived from the transducer outputs to shift the directional response pattern of the microphone array so that it is centered in the direction of the preferred location indicated by location signal L. While only one preferred location is shown, it is to be understood that one of several locations may be specified. The tap weighting signals $h_{ij}$ are initially set to 0 except tap weighting signal $h_{i,T/2}$ which is set to 1/M (step 310) and the input power signal $S_1$ as well as the power gradient signals $S_{ij}$ for microphones $i=1, 2, \ldots, M$ and taps $j=1, 2, \ldots, T$ are also set to zero (step 315) in processor 260. This selection of tap weights corresponds to a uniformly weighted array having an expected maximum response in the direction of the desired source.

Figure 5:
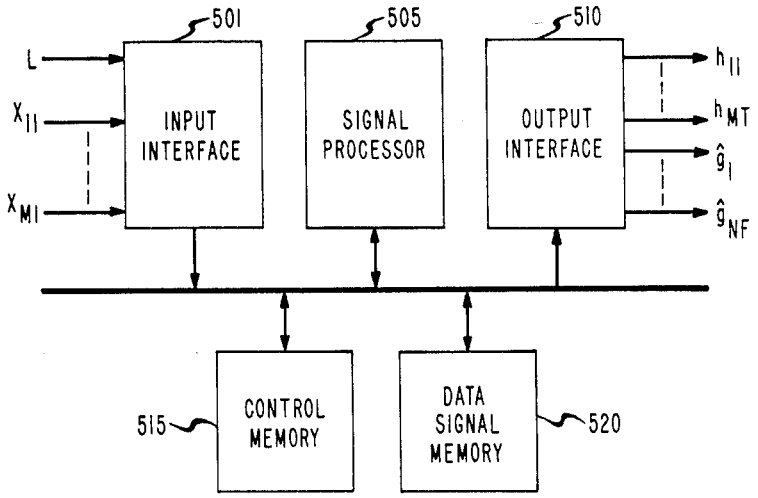
FIG. 5 depicts a block diagram of a circuit adapted to perform the filtering operations of FIG. 1.

Processor 260 is shown in greater detail in the block diagram of FIG. 5. Referring to FIG. 5, location signal L and the sampled microphone signals $x_{11}$ through $x_{M1}$ are applied to input interface 501 and are stored in data signal memory 520. These signals and other data signals derived therefrom are made available to signal processor 505 under control of instructions permanently stored in control memory 515. These stored instructions are set forth in Fortran language form in Appendix A hereto. The $h_{11}$ through $h_{MT}$ transversal tap weighting signals and the $g_1$ through $g_{NF}$ inverse filter tap weighting signals are generated in processor 505 and transferred via output interface 510 to the multipliers of the transversal filters, e.g., 220-1 through 220-1T, and multipliers 240-1 through 240-NF of the inverse filter in FIG. 2 as directed by the instructions stored in control memory 515. The current location signal L corresponding to the desired sound source is stored in data signal memory 520 after being determined as is well known in the art in processor module 202 of FIG. 2, and the initial tap weighting signals are set in processor 505 and stored in data signal memory 520 under control of control memory 515. Processor 505 may comprise the MC68020 type microprocessor described in the Motorola MC 68020 32-BIT Microprocessor User's Manual, Prentice Hall Inc., Englewood Cliffs, N.J. The read only and random access memories as well as the input and output interfaces may comprise integrated circuit devices well known in the art that are compatible with processor 505.

In FIG. 2, signals $s_1$ to $s_M$ corresponding to acoustic waves at the transducers 101-1 to 101-M, respectively, are applied to filter and sample circuit 205. Each signal, e.g., $s_1$, is low passed filtered therein to eliminate unwanted high frequency components. The filtered signal is then sampled at a predetermined rate to form a sequence of samples representative thereof and the sample signals are converted into digital code sequences in analog-to-digital converter 207. Digitally coded sample signals derived from transducer 101-1 in analog to digital converter 207 are applied to location delay 210-1 to which delay signals are also applied in accordance with location delay control signal $\delta_1$ from processor 260. In similar manner, signals derived from transducer 101-2 through 101-M are delayed in location delays 210-2 through 210-M of transversal filters 201-2 through 201-M responsive to delay control signals $\delta_2$ through $\delta_m$, respectively.

The digital signal samples from location delays 210-1 through 210-M are applied to the input stages of shift registers 215-1 through 215-M, respectively of transversal filters 201-1 through 201-M. Each of these shift registers has N stages so that a block of N successive samples may be stored at a time. The sample index n is reset to zero in processor 260 as per step 317 of FIG. 3, and the circuit operation loop from step 320 to step 340 is entered. Sample index n is incremented (step 320). As long as $n \leqq N$, the circuit operation loop is iterated so that the microphone tap signals $x_{ij}$ are shifted one stage down whereby $x_{ij}=x_{i,j-1}$ for microphone index $i=1, 2, \ldots, M$ and tap index $j=2, \ldots, T$ (step 330) and the sample signal $x_{i1}$ is then shifted into the first stage of each shift register. i corresponds to the ith transversal filter in the set $1=1, 2, \ldots, M$ of M filters and j corresponds to the jth tap in the set $j=1, 2, \ldots, T$ of T taps. For each shift of steps 330 and 335, an output signal $$o(n) = \sum_{i=1}^{M} \sum_{j=1}^{T} x_{ij}(n)h_{ij}(n), \tag{20}$$

an input power signal $$P_{in}(n) = \sum_{i=1}^{M} \sum_{j=1}^{T} x_{ij}(n)^2 \tag{21}$$

a cumulative input power signal up to sample n of the current block $$S_1=S_1+P_{in}(n), \tag{22}$$

and power gradient signals up to sample n $$S_{ij}=S_{ij}+2o(n)x_{ij}(n) \tag{23}$$

are formed for $i=1, 2, \ldots, M$ and $j=1, 2, \ldots, T$ as per step 340.

Figure 10:
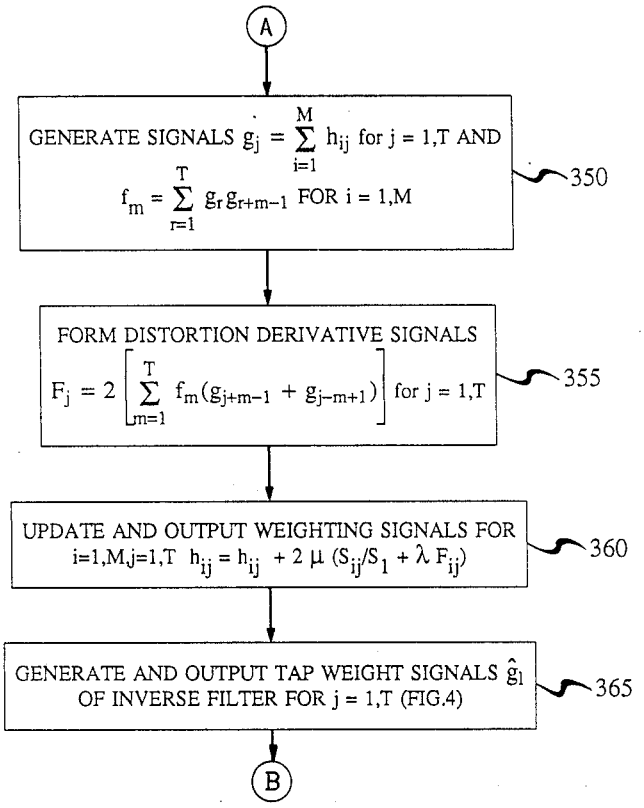

With reference to FIG. 2, the signal o(n) at the output of summing device 230 is formed by the multiplication of signals $h_{ij}$ from filter parameter processor 260 and signals $x_{ij}$ from the shift registers in multipliers 220-ij, summing the products $h_{ij}x_{ij}$ for each microphone shift register in summers 225-1 through 225-M, and generating the sum of the outputs of these summers in summing device 230. Signals $P_{in}(n)$, $S_1$, and $S_{ij}$ are formed in filter parameter processor 260 from the sample signals $x_{ij}$ applied thereto and the current block weighting signals $h_{ij}$ so that weighting signals for the next block of N input samples may be generated. The weighting signals for the next block are formed according to steps 350, 355 and 360 of FIG. 10. Step 350 is entered from step 325 of FIG. 3 after the $x_{iN}$ sample signals have been processed in filter parameter processor 260. A signal corresponding to the impulse response for each tap $$g_j = \sum_{i=1}^{M} (h_{ij})j = 1,T \tag{25}$$

is then generated. The distortion derivative of equation 13 may be expressed directly in terms of the tap weights $g_j$ of equation 6 as $$f_m = \sum_{r=1}^{T} g_r g_{r+m-1}. \tag{26}$$

It is to be understood that the term $g_{r+m-1}$ in equation 26 is zero whenever $r+m-1>T$. The distortion in equation 2 may be expressed as $$D = \sum_{m=1}^{T} f_m^2 \tag{27}$$

and the derivative of distortion D with respect to $h_{ij}$, which is independent of the microphone index, $$F_j = 2\left(\sum_{m=1}^{T} f_m(g_{j+m-1} + g_{j-m+1})\right) \tag{28}$$

is produced in step 355 for $j=1, T$. The weighting signals updated for the current block in accordance with $$h_{ij}=h_{ij}-2\mu(S_{ij}/S_1+\lambda F_j) \tag{29}$$

are then generated for the next sample block and output to the multiplier circuits 220-ij of FIG. 2 (step 360).

Figure 4:
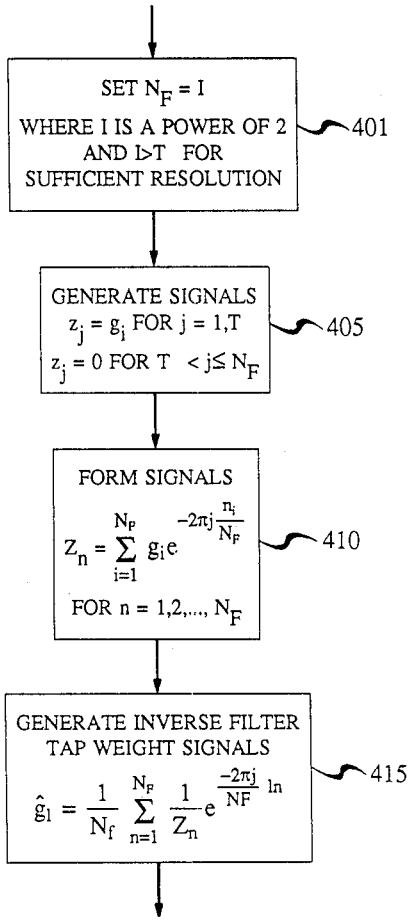

Step 365 is then entered wherein the tap weight signals for multipliers 240-1 through 240-$N_F$ of the inverse filter in FIG. 2 are generated and output thereto for the next sampling block. The operations performed in step 365 are shown in greater detail in the flow chart of FIG. 4. Referring to FIG. 4, step 401 is entered from step 360 of FIG. 10 after the next sampling block weighting signals have been produced. In step 401, the number of inverse filter tap weights is set to I which is an integer that is a power of 2 and greater than the number of tap weights of the microphone filter circuits. A set of impulse response signals $z_j$ is formed as per equations 16 and 17 (step 405) and the Fourier transform signals $Z_n$ of impulse response signals $z_j$ are generated in accordance with equation 18 (step 410).

Step 414 is then entered wherein the inverse tap weight filter signals $\hat{g}_j$ are produced after forming the signals $1/Z_n$ in accordance with equation 19. The next sample block processing is then initiated in step 315 of FIG. 3 using the just generated tap weight signals $h_{ij}$ and $g_j$. The loop from step 315 through step 365 is repeated with tap weight signals that are modified for each sample block in accordance with the received acoustic signals, the tap weight signals of the preceding block and the signal indicating the location of the desired sound source.

Figure 7:
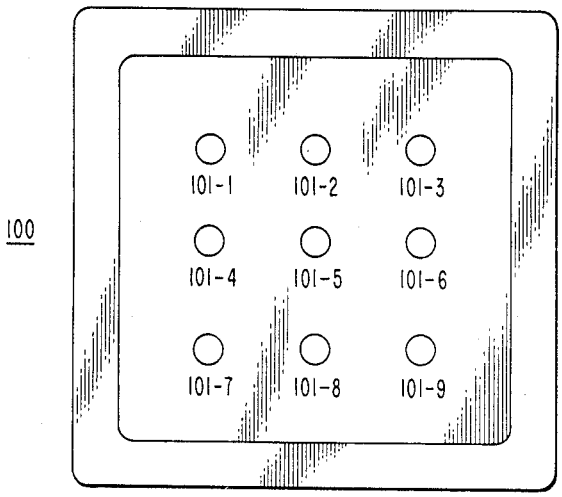
FIGS. 7–9 illustrate a two-dimensional microphone array structure incorporated in a terminal display useful in the circuit of FIG. 1.
Figure 8:
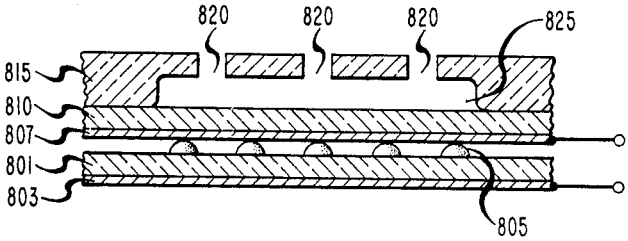
Figure 9:
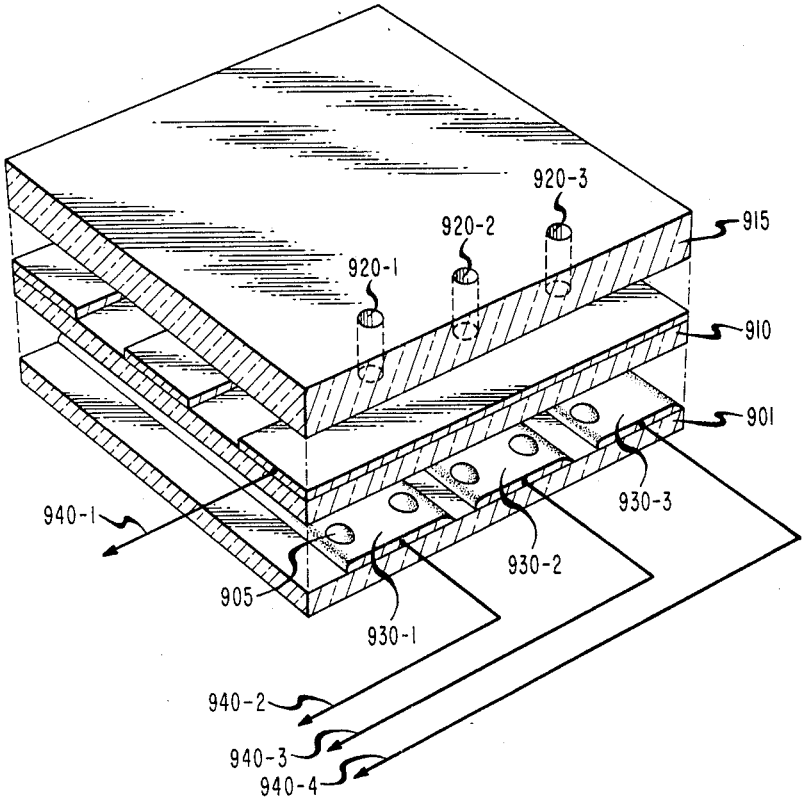

The microphone array of FIG. 2 may be part of a display arrangement illustrated in greater detail in FIG. 7 and the construction of the microphones as part of the display is shown in FIGS. 8 and 9. In FIG. 7, the microphones 101-1 through 101-9 are an integral part of the display and are spaced so that the main lobe of the directional response pattern (610 in FIG. 6) may be restricted to the immediate vicinity of the desired location SL without interfering with the view of the operator. The transducer structures shown in FIG. 7 can be transparent as illustrated in FIGS. 8 and 9. It is to be understood that individual microphones may also be used. The placement of such individual microphones on the display unit or at the periphery thereof, however, may result in a less optimum directional pattern main lobe or may obstruct viewing the display panel.

Referring to FIG. 7, microphone units 101-1 through 101-9 form a spaced rectangular array of electret transducers. The output of each microphone unit is applied to one of the transversal filters in FIG. 1. As shown in FIG. 8, each microphone comprises a transparent metallized layer 803 (indium-tin-oxide) placed on the lower surface of teflon sheet 801 that has been given a permanent charge. The upper surface of sheet 801 has spaced posts 805 supporting a second mylar sheet 810 with a transparent metalized (indium-tin-oxide) layer 807 on its lower surface. Covering layer 815 is placed on the other surface of mylar layer 810. Layer 810 may have metallized layers on both upper and lower surfaces. Regularly spaced RTV posts 805 are placed on the upper surface of layer 801. Layer 801 may be a 25 μm teflon sheet while layer 810 may be a 10 μm mylar diaphragm having a metallized lower surface. Covering layer 815 may be made of 25 μm mylar with a hollow section 825 over each microphone location and apertures 820 connecting the hollow section to the atmosphere. Other materials and arrangements may also be used.

FIG. 9 illustrates the overall construction of an alternative microphone array unit covering a display area. In FIG. 9, 10–20 μm mylar layer 901 has RTV posts 905 on its upper surface as well as separated indium tin oxide metal strips 930-1, 930-2 and 930-3. 10–20 μm teflon sheet 910 is effective as a diaphragm and has a charged lower surface. Separated metallized strips are placed on the upper surface of teflon sheet 910. 10–20 μm covering layer 915 is placed on diaphragm layer 910. The covering layer has apertures 920-1, 920-2, and 920-3 over metallic strips 930-1, 930-2, and 930-3 which define the active microphone areas. The output of the microphone at aperture 920-1 appears between leads 940-1 and 940-2. The output of the microphone at aperture 920-2 appears between leads 940-1 and 940-3 and the output of the microphone at aperture 920-3 appears between leads 940-1 and 940-4. The layers shown in FIG. 9 are transparent and do not interfere with display functions. While electret type transparent electroacoustic transducers are shown in FIGS. 8 and 9, it is to be understood that transparent externally biased condenser transducer structures may also be used.

While a line array may be used in the circuit of FIG. 1, the directivity pattern revolves as a toroid about the axis of the array as is well known in the art wherein the preferred location L is selected along with sounds from all directions within the toxoidal pattern. Consequently, selection of a preferred location directly in front of the display device results in pick up of sounds from within the toroidal mainlobe and relatively poor discrimination against noise sources within the mainlobe. The two-dimensional array shown in FIG. 7 provides two-dimensional control so that a cigar-shaped mainlobe pattern is obtained and improved discrimination against noise sources. Thus, the cigar-shaped mainlobe is directed toward the preferred location L and a noise source outside the cigar-shaped response pattern results in a null point in the response pattern for that noise source.

The invention has been illustrated and described with reference to a particular embodiment thereof. It is to be understood, however, that various changes and modifications may be made by those skilled in the art without departing from the spirit and scope of the invention. For example, the microphones in the array may be of the directional type to improve the noise immunity and a frequency weighting function may be used in the distortion signal of equation 2 to provide different weighting to different frequency regions.

Appendix A

```
      parameter(maxtaps=2**8,maxmics=8, nsamples=25000)
      parameter(nfft=maxtaps, mcomp=1+nfft/2)
      dimension
      ix(nsamples,maxmics),h(maxtaps,maxmics),grad(maxtaps,
      maxmics)
      dimension xpos(maxmics),ypos(maxmics),zpos(maxmics)
      dimension hm(nfft+2), dgrad(maxtaps),h1(nfft+2)
      dimension rrdata(mcomp)
      integer*2 sout(nsamples)
      complex d(mcomp), dd, ex,hw,d1(mcomp)
      equivalence (d,hm)
      equivalence (d1,h1)
      real theta,thetar,phi,phirad,ptmax,pc,ps
      real ptotj,radian,wk,wk1,wkss1
      real ptot(365),thlo,thhi,thss
      real a(maxmics),alpha(maxmics),delta(maxmics)
      real samprate,ccost(100),cpcost(100),cdcost(100),weight(100)
      real hmax,hmin,rmcomp,fresp(mcomp)
      real fresp1(mcomp,fresp1max,fresp1min,thetad,phid,
      xaxis(mcomp)
      real xaxis2(nfft)
      character*20 ifile
      integer ipltiter,nnfreqs,ians,nblks,ilim
      data ccost/100*0./
      data cdcost/100*0./
      data cpcost/100*0./
c
      ptmax=1.e-6
      tpi= 8.* atan(1.)
      radian=1/57.29578
      wkmax=tpi/(2.*343e2)
```

-continued

Appendix A

```
c
c     READ IN THE INITIAL SETUP PARAMETERS
c
      call openas (0,"anredparams",0)
      read(0,*) nmics,ntaps
c
      if(ntaps.gt.maxtaps) go to 1000
      if(nmics.gt.maxmics) go to 1002
c
      read(0,*) nav,maxtry
      read(0,*) alphap
      read(0,*) xmu,xmugain
      alphad=1.-alphap
      do 555 j=1,nmics
      read(0,*) xpos(j),ypos(j),zpos(j)
555   continue
      read(0,*)samprate
      read(0,*)ipltiter
      read(0,*)nnfreqs
      read(0,*)thetad,phid
      rntaps=float(ntaps)
      wkmax=wkmax*samprate
      wkss=wkmax/nnfreqs
      fkss=wkmax*343./(tpi*float(mcomp-1))
      wkst=wkss
      close (0)
      wk1=0.0
      rmcomp=float(mcomp)
      wkss1=wkmax/rmcomp
      xnfft=nfft
      xnav=nav
      xntaps=ntaps
c
c     INITIALIZE THE DATA, FILTERS, AND GRADIENT
      ARRAYS
c
      call zero(dgrad,maxtaps)
      call zero(hm,nfft+2)
c     call zero(h1,nfft+2)
      call izero (sout,nsamples)
      do 9 im=1,maxmics
      call zero(h(1,im),maxtaps)
      call izero(ix(1,im),nsamples)
      call zero(grad(1,im),maxtaps)
9     continue
c
c     READ IN A DATA BLOCK
c
      do 100 im=1,nmics
      h(ntaps/2,im)=1./float(nmics)
      write (ifile,99) im
      call rdsi (0,ifile)
      call rsect(0,ix(1,im),nsamples,1.,ieof)
      if(ieof.ne.0) stop "read error"
      close (0)
100   continue
99    format("s",i1)
c
      close (0)
      ntry=0
      niter=0
      ssq=0.
      xsq=0.
      last=niter
      ijiter=0
      jjj=1
      jj=0
999   format(9f8.5)
111   continue
      niter=niter+1
      if(niter.ge. nsamples-ntaps) go to 1005
c
c
c
c     COMPUTE SIGNAL
c
      s=0.
      do 2 it=1,ntaps
      do 2 im=1,nmics
      xx=ix(niter+ntaps-it,im)
      xsq=xsq+xx**2
```

-continued

Appendix A

```
2     s=s+xx*h(it,im)
      if(xsq.eq.0.)go to 111
c
c
c
c     ACCUMULATE OUTPUT ENERGY
c
      ssq=ssq+s**2
c
c
c     ACCUMULATE GRADIENT OF POWER
c
c
      do 3 it=1,ntaps
      do 3 im=1,nmics
      xx=ix(niter+ntaps-it,im)
      grad(it,im)=grad(it,im)+ s*xx
3     continue
c
c
c
      if(mod(niter,nav) .ne. 0) go to 111
c
c
c     COMPUTE GRADIENT OF DISTORTION
c
c
c     call zero(h1,nfft+2)
      do 1 it=1,ntaps
      hm(it)=0.
      do 1 im=1,nmics
      hm(it)=hm(it)+h(it,im)
1     continue
c
c
      do 12 it=ntaps+1,nfft+2
12    hm(it)=0.
c
c     FIND FREQUENCY RESPONSE IN DESIRED LOOK
      DIRECTION
c
      call fast(hm,nfft)
      call fast(h1,nfft)
      dist=0.
      do 4 it=1,ntaps
      dgrad(it)=0.
      xit=it-1
      do 5 it2=1,nfft
      if(it2.le.mcomp)dd=d(it2)
      if(it2.le.mcomp)fresp(it2)=cabs(dd)
      if(it2.gt,mcomp) dd=conjg(d(nfft+2-it2))
      dd2=cabs(dd)**2
c
c     CALCULATE THE FREQUENCY RESPONSE
      MAGNITUDE DISTORTION
c
      if(if.eq.1 .and. it2 .gt. 50) dist=dist+((1.-dd2)**2)
      xit2=it2-1
      ex=cmplx( 0., tpi*xit*xit2/xnfft)
c
c     COMPUTE THE GRADIENT OF THE DISTORTION
      WITH RESPECT TO THE WEIGHTS
c
      if(it2 .gt. 50)dgrad(it)=dgrad(it) - (1-dd2) * areal
      (dd*cexp(ex))
5     continue
4     continue
c
c
c
c     COMPUTE COST
c
      powercost=alphap*ssq/xsq
      distcost=alphad*dist/xnfft
      cost= powercost + distcost
      ijiter=ijiter+1
      jj=jj+1
      if(jj.gt.100)jj=jj-100
      cpcost(jj)=10.*alog10(powercost)
      cdcost(jj)=10.*alog10(1.0e-10+distcost)
      ccost(jj)=10.*alog10(cost)
```

-continued

Appendix A

```
c
c
c     UPDATE GAINS
c
c
      do 61 it=1,ntaps
      dg=dgrad(it)
      dgrad(it)=0.
      do 6 im=1,nmics
      h(it,im)= h(it,im) -2.*xmu*(alphap*grad(it,im)/xsq + alphad
      *dg/xnfft)
      grad(it,im)=0.
6     continue
61    continue
62    continue
      weight (jjj)=h(1,1)
      jjj=jjj+1
      if(jjj.gt.100)jjj=jjj-100
      ssq=0.
      xsq=0.
c
      ntry=ntry+1
      if(ntry.eq.maxtry) last=niter
      if(ntry.eq.maxtry) ntry=0
      niter=last
      if(ntry.ne.0)go to 111
      if(mod(ijiter,ipltiter).ne.0)go to 111
c
1005  phi=90.
      phirad=phi*radian
      thss=1.
      theta=-thss
      thlo=0.
      thhi=180.
      nth=181
      wk=wkst-wkss
      ptmax=0.0
      do 53 j=1,nth
53    ptot(j)=0.0
c
c     COMPUTE THE FREQUENCY RESPONSE OF THE
      ARRAY
c
      do 55 ij=1,nnfreqs
      wk=wk+wkss
      do 31 j=1,nmics
c
c
      hw=cmplx(0.,0.)
c
c     COMPUTE THE FREQUENCY RESPONSE OF EACH
      TRANSVERSAL FILTER
c
      do 32 i=1,ntaps
      hw=hw+h(i,j)*cexp(cmplx(0.,-float(i-1)*wk*3.43e2/
      (samprate)))
32    continue
      a(j)=cabs(hw)
      alpha(j)=atan2(aimag(hw),real(hw))
31    continue
      theta=-thss
      do 51 j=1,nth
      pc=0.
      ps=0.
      theta=theta+thss
      thetar=theta*radian
      do 25 k=1,nmics
      delta(k)=(alpha(k))+(wk*((pos(k)*sin(phirad)*cos(thetar))
      1 +(ypos(k)*sin(phirad)*sin(thetar))+(zpos(k)*cos(phirad))))
      pc=pc+a(k)*cos(delta(k))
      ps=ps+a(k)*sin(delta(k))
25    continue
      ptot(j)=ptot(j)+cabs(cmplx(pc,ps))
      ptotj=ptot(j)
      if(ptotj.gt.ptmax)ptmax=ptotj
51    continue
55    continue
c
c
c     COMPUTE THE RESPONSE IN THE THETAD AND
      PHID DIRECTION
```

-continued

Appendix A

```
c
      wk1=0.0
      do 155 ij=1,mcomp
      wk1=wk1+wkss1
      do 131 j=1,nmics
      hw=cmplx(0.,0.)
      do 132 i=1,ntaps
      hw=hw+h(i,j)*cexp(cmplx(0.,-float(i-1)*wk*3.43e2/
      (samprate)))
132   continue
      a(j)cabs(hw)
      alpha(j)=atan2(aimag(hw),real(hw))
131   continue
      thetar=thetad*radian
      phirad=phid*radian
      pc=0.
      ps=0.
      do 125 k=1,nmics
      delta(k)=(alpha(k))+(wk1*((xpos(k)*sin(phirad)*cos(thetar))
      1 +(ypos(k)*sin(phirad)*sin(thetar))+(zpos(k)*cos(phirad))))
      pc=pc+a(k)*cos(delta(k))
      ps=ps+a(k)*sin(delta(k))
125   continue
      fresp1(ij)=cabs(cmplx(pc,ps))
      if(ij.eq.1)fresp1max=fresp1(ij)
      if(ij.eq.1)fresp1min=fresp1(ij)
      if(fresp1(ij).gt.fresp1max)fresp1max=fresp1(ij)
      if(fresp1(ij).lt.fresp1min)fresp1min=fresp1(ij)
      ",fresp1max
155   continue
      xmu=xmu*xmugain
      if(niter .ge. nsamples-ntaps)go to 1001
      go to 111
c
c     COMPUTE OUTPUT SIGNAL
c
c
c
      nblks=(niter/256)-1
957   if(mod(nblks,3).ne.0)nblks=nblks-1
      if(mod(nblks,3).ne.0)go to 957
      do 8 is=1,niter-1
      sum=0.
      do 7 it=1,ntaps
      do 7 im=1,nmics
      xx=ix(is+ntaps-it,im)
      sum=sum+xx*h(it,im)
7     continue
      sout(is)=int(sum)
8     continue
      call openbn (0,"outanred", 1)
      write(0) sout
      close (0)
c
c     STORE THE ARRAY FILTER COEFFICIENTS
c
      call openbn(0,"hfilter",1)
      do 331 it=1,ntaps
      do 332 im=1,nmics
      write(0) h(it,im)
332   continue
331   continue
      close(0)
c
c     COMPUTE THE ADAPTED LOOK DIRECTION
      FREQUENCY RESPONSE
c
      do345 it=1,ntaps
      hm(it)=0.
      do 345 im=1,nmics
      hm(it)=hm(it)+h(it,im)
345   continue
      do 364 it=ntaps+1,nfft
364   hm(it)=0.
      call fast(hm,nfft)
      do 365 j=1,mcomp
      if(j.eq.1)respmax=cabs(d(j))
      if(cabs(d(j)).gt.respmax)respmax=cabs(d(j))
365   continue
c
c     COMPUTE THE INVERSE FILTER RESPONSE TO
```

-continued

Appendix A

```
c     FLATTEN THE LOOK DIRECTION RESPONSE
c
      dbmin=-50.
      rmin=10.**(dbmin/20.)
      ichop=0
      do 366 j=1,mcomp
      rrdata(j)=cabs(d(j))
      if(rrdat(j) .gt. 0.)then
        if(rrdata(j)/respmax .lt. rmin)then
          rrdata(j)=1./rmin
        else
          rrdata(j)=respmax/(rrdata(j))
        endif
      else
        rrdata(j)=0.
      endif
      if(j.le.ichop)rrdata(j)=0.
366   continue
      do 367 j=1,mcomp
      xaxis(j)=float(j-1)*samprate/(nfft)
      if(j.eq.1)rmax=rrdata(j)
      d1(j)=rrdata(j)*d(j)
367   if(rrdata(j).gt.rmax)rmax=rrdata(j)
      call fsst(h1,nfft)
      do 368 j=1,mcomp
      if(rrdata(j).gt.0.)fresp(j)=20.*alog10(rdata(j)/rmax)
      if(rrdata(j).eq.0.)fresp(j)=dbmin
      if(fresp(j).le.dbmin)ichop=j
      if(fresp(j).lt.dbmin)fresp(j)=dbmin
      if(cabs(d(j)).gt.0.)fresp1(j)=20.*alog10(cabs(d(j))/respmax)
      if(cabs(d(j)).eq.0.)fresp1(j)=dbmin
      if(fresp1(j).lt.dbmin)fresp1(j)=dbmin
368   continue
      ilim=50
      do 456 j=1,ilim
      if(j.eq.1)hmax=h1(j)
      if(j.eq.1)hmin=h1(j)
      if(h1(j).gt.hmax)hmax=h1(j)
      if(h1(j).lt.hmin)hmin=h1(j)
      xaxis2(j)=float(j)
456   continue
c
c     "INVERSE" FILTER TO FLATTEN THE ARRAY LOOK
      DIRECTION RESPONSE
c
      call magfilt("outanred","flatout",rrdata,nfft,nblks)
      print *,'Flattened data stored in file flatout'
      print *,''
      stop
      end
c
c
```

What is claimed is:

1. In apparatus including an array of microphone elements having a prescribed directional response pattern for receiving sound signals, and a signal processor for adjusting said prescribed directional response pattern, the method for processing sound comprising the steps of:

defining a preferred sound source location in said signal processor;

defining a sequence of successive time intervals for analyzing said received sound signals in said signal processor;

receiving a sound signal from said preferred sound source location and a plurality of sound signals from other locations at the microphone elements of the array;

forming a set of weighting signals during each analysis time interval in said signal processor to adjust the directional response pattern of said array of microphone elements;

combining the received sound signals with said weighting signals to produce an output signal corresponding to the sound signal from the preferred location sound source while attenuating the sound signals from said other locations in each analysis time interval;

the weighting signal forming step including;

generating a signal representative of the input power of the received sound signals and a signal representative of the power of an output signal of a current time interval responsive to the sound signals received in the current analysis time interval; and producing a set of weighting signals for the current analysis time interval in said signal processor to direct the mainlobe of the prescribed directional response pattern toward the sound signal from the preferred location while directing minimum response points of the prescribed directional response pattern toward the sound signals from other locations responsive to the weighting signals of a preceding analysis time interval, the current analysis time interval input power and output power signals and the preferred location defining signal and a calculated, limited distortion.

2. Apparatus for processing sounds of the type comprising:

means for generating a signal defining a preferred location from which to receive wanted sounds;

receiving means responsive to sounds from the preferred location and unwanted sounds from other changeable locations not including said preferred location for producing signals corresponding to said preferred location sounds and said chrageable location sounds including an array of microphone elements having a prescribed directional response pattern comprising a mainlobe and a plurality of sidelobes separated by minimum response points;

means for defining successive time intervals, each for analyzing the preferred source sound signals and the plurality of other changeable location unwanted sound signals;

means for forming a set of weighting signals in each analysis time interval, of the type used to adjust the directional response pattern of the array of microphone elements; and means for combining the received sound signals with said weighting signals to direct the mainlobe of the array directional response pattern toward the preferred location while directing minimum response points of the array directional response pattern toward the other changeable locations and to produce an output signal substantially representative of the sound signal from the preferred location in each analysis time interval;

said apparatus being improved in that said weighting signal forming means includes;

means responsive to the sound signals received from said preferred location and from said other changeable locations in a current analysis time interval for generating a signal representative of the input power of the received sound signals, and a signal representative of the power of an output signal of the current time interval; and means responsive to the weighting signals of a preceding anaylsis time interval, the current analysis time interval input power signal and the output power signal and the preferred location defining signal for producing a set of weighting signals for the current analysis time interval, including means for calculating from the preceding analysis time interval weighting signals and said defining signal a measure of distortion to modify the set of preceding time interval weighting signals according to the following criterion:

said weighting signal forming means and the combining means iteratively decrease the output power signal towards a minimum while maintaining said calculated measure of distortion at a set value, whereby the result is to maintain the ratio of the output signal power to the power of the input signal of sound from the preferred location substantially at unity over a prescribed frequency range, while decreasing the signals from all other sources.

3. Apparatus for processing sound according to claim 2 wherein:

said receiving means comprises means responsive to said received sound signals from each microphone element for generating a sequence of samples thereof in each analysis time interval;

means for partitioning the sequence of received signal samples into successive blocks, each block occurring during one of the analysis time intervals; and said means for combining the weighting signals of the preceding analysis time interval, the current analysis time interval input power and output power signals and the preferred location defining signal to modify the set of preceding time interval weighting signals comprises means responsive to the weighting signals of the preceding block, the sequence of received acoustic signal samples of the present block, said preferred location defining signal and said output signal of said present block for producing the current analysis time interval weighting signals for the present block of sound signal samples.

4. Apparatus for processing sound according to claim 3 wherein:

said means for modifying the weighting signals $h_{ij}$ of the preceding analysis time interval comprises means for generating a signal $$F_j = 2\left(\sum_{m=1}^{T} f_m(g_{j+m-1} + g_{j-m+1})\right)$$

where $$g_j = \sum_{j=1}^{M} (h_{ij})j = 1,T$$

and $$f_m = \sum_{r=1}^{T} g_r g_{r+m-1}$$

and updating the weighting signals $h_{ij}$ of the preceding analysis time interval in accordance with $$h_{ij}=h_{ij}-2\mu(S_{ij}/S_1+\lambda F_j)$$

where $$S_{ij} = 2\sum_{n=1}^{N} o(n)x_{ij}(n),$$

-continued $$S_1 = \sum_{n=1}^{N} P_{in}(n)$$

and $\mu$ is a prescribed step size.

5. Apparatus for processing sound according to claim 4 wherein:

said means for combining the received sound signals with said weighting signals to produce an output signal substantially representative of the sound signal from the preferred location in each analysis time interval comprises M transversal filters each having means for successively receiving sound sample signals from one of said microphone elements, means for receiving the weighting signals of the current analysis time interval, means for selectively multiplying said weighting signals of the current analysis time interval and the successively received sound sample signals, and means for summing said multiplied weighting signals and said successively received sound sample signals to form a transverse filter signal; and means for summing the M transverse filter signals to form said output signal o(n).

6. Apparatus for processing sound according to claim 5 further comprising:

means for modifying said output signal o(n) including;

means responsive to the current block weighting signals for generating a set of signals corresponding to the inverse of the current block weighting signals; and transverse filter means comprising means for successively receiving samples of said output signals, means for receiving said inverse weighting signals of the current time interval, and means for combining the successive samples of said output signal with said inverse weighting signals of the current analysis time interval to amplify the low frequency spectral portion of the output signal.

7. In a system having a visual monitor, apparatus for processing sound comprising:

an array of spaced electroacoustic transducers integral with said monitor having a prescribed directional response pattern including a mainlobe and a plurality of sidelobes separated by minimum response points for receiving sound signals from a plurality of sound sources at other locations;

means for generating a signal defining at least one preferred location sound source relative to said monitor;

means for generating signals defining successively occurring repetitive sound analysis time intervals;

means for forming a set of signals for weighting the transducer sound signals in each analysis time interval and;

means for combining said received sound signals with said set of weighting signals to form an output signal substantially representative of the sound signal from the preferred location sound source in each analysis time interval without regard to silence periods of the sound sources;

said weighting signal forming means including;

means responsive to the sound signals received in a current analysis time interval for generating a signal representative of the input power of the received sound signal and a signal representative of the power of an output signal of the current time interval; and means responsive to the weighting signals of a preceding analysis time interval, the current analysis time interval input power and output power signals and the preferred location defining signal for producing a set of weighting signals for the current analysis time interval to direct the mainlobe of the array directional response pattern toward the sound signal from the preferred location while directing the minimum response points of the prescribed directional response pattern toward the sound signals from other locations, wherein said weighting signal producing means modifies a set of preceding time interval weighting signals in accordance with a calculated measure of distortion limited to a set non-zero value to decrease the aforesaid output power signal toward a minimum, whereby it approximates said signal from said preferred location over a prescribed frequency range.

8. In a system having a visual monitor, apparatus for processing sound according to claim 7 wherein said array of spaced electroacoustic transducers integral with said monitor comprises an array of transparent electroacoustic transducers.

9. In a system having a visual monitor, apparatus for processing sound according to claim 8 wherein said array of transparent electroacoustic transducers comprises transparent condenser transducers.

10. In a system having a visual monitor, apparatus for processing sound according to claim 9 wherein said transparent condenser transducers comprise transparent electret condenser transducers.

11. A system as claimed in claim 7, in which the combining means includes a plurality of transversal filter means each coupled to one of said transducers for combining the set of weighting signals with the signals received by said transducers to produce an output signal substantially representative of the sounds from said preferred location.

12. A system as claimed in claim 11, including an inverse filter that affects the prescribed frequency range over which the limited distortion is maintained.

13. In apparatus including an array of microphone elements having a prescribed directional response pattern and a signal processor for adjusting the array directional response pattern, the method for processing sound according to claim 1 wherein the step of producing the set of weighting signals for the current analysis time interval to direct the mainlobe of the array directional response pattern toward the sound signal from the preferred location while directing the minimum response points of the aray directional response pattern toward the sound signals from other locations includes combining the weighting signals of the preceding analysis time interval, the current analysis time interval input power and output power signals and the preferred location defining signal to modify the set of preceding time interval weighting signals to decrease the power of the current analysis time interval output signal towards a minimum while maintaining a calculated, limited distortion near a prescribed value, whereby the result is to maintain the ratio of the output signal power to the power of the input signal of the sound signal from the preferred location substantially at unity over a prescribed frequency range, while decreasing the signals from all other sources.

* * * * *

UNITED STATES PATENT AND TRADEMARK OFFICE

CERTIFICATE OF CORRECTION

PATENT NO. : 4,802,227

DATED : January 31, 1989

INVENTOR(S) : Gary W. Elko, Man M. Sondhi, James E. West

It is certified that error appears in the above-identified patent and that said Letters Patent is hereby corrected as shown below:

Column 18, line 31, "chrageable" should read --changeable--.
Column 18, line 37, "source sound" should read --source location sound--.
Column 19, line 52, " $\sum_{j=1}^{M}$ " should read -- $\sum_{i=1}^{M}$ --.
Column 20, line 68, "sound signal" should read --sound signals--.
Column 22, line 20, "aray" should read --array--.

Signed and Sealed this

Eighth Day of October, 1991

*Attest:*

*Attesting Officer*

HARRY F. MANBECK, JR.

*Commissioner of Patents and Trademarks*